US009516422B2

(12) United States Patent
Ohara

(10) Patent No.: US 9,516,422 B2
(45) Date of Patent: Dec. 6, 2016

(54) WEAVING METHOD FOR A DAMPER OF A LOUDSPEAKER

(71) Applicant: Hiroshi Ohara, Taoyuan County (TW)

(72) Inventor: Hiroshi Ohara, Taoyuan County (TW)

( * ) Notice: Subject to any disclaimer, the term of this patent is extended or adjusted under 35 U.S.C. 154(b) by 95 days.

(21) Appl. No.: 14/623,058

(22) Filed: Feb. 16, 2015

(65) Prior Publication Data

US 2016/0241964 A1 Aug. 18, 2016

(51) Int. Cl.

| | |
|---|---|
| ***H04R 9/06*** | (2006.01) |
| ***D03D 1/00*** | (2006.01) |
| ***H04R 9/04*** | (2006.01) |
| ***D03D 15/02*** | (2006.01) |
| *H04R 31/00* | (2006.01) |

(52) U.S. Cl.

CPC ..... *H04R 9/043* (2013.01); *D03D 1/0088* (2013.01); *D03D 15/02* (2013.01); *D10B 2101/20* (2013.01); *D10B 2401/16* (2013.01)

(58) Field of Classification Search

CPC ..... D03D 15/02; D03D 1/0088; D03D 13/00; D03D 15/00; D03D 5/0066; D03D 13/002; D03D 15/0011; D10B 2401/16; D10B 2101/20; D10B 2403/02431; H04R 2307/025; H04R 2307/023; H04R 2307/029; H04R 7/04; H04R 7/12; H04R 9/043; H04R 2307/027; H04R 7/02; H04R 9/06

See application file for complete search history.

(56) References Cited

U.S. PATENT DOCUMENTS

| | | | | |
|---|---|---|---|---|
| 4,030,564 | A * | 6/1977 | Itagaki | G10K 11/002 181/158 |
| 7,606,387 | B2 * | 10/2009 | Ohara | H04R 7/12 381/426 |
| 8,299,654 | B2 * | 10/2012 | Yamamoto | H01B 7/30 307/147 |
| 9,039,800 | B2 * | 5/2015 | Elsasser | B01D 39/20 55/486 |
| 2006/0035554 | A1 * | 2/2006 | Glaser | D02G 3/441 442/301 |
| 2007/0177758 | A1 * | 8/2007 | Ohara | H04R 7/12 381/426 |
| 2007/0190881 | A1 * | 8/2007 | Shibaoka | D03D 1/0088 442/228 |
| 2007/0192647 | A1 * | 8/2007 | Glaser | D03D 1/0088 713/330 |
| 2007/0283677 | A1 * | 12/2007 | Ohara | D02G 3/12 57/210 |
| 2007/0287344 | A1 * | 12/2007 | Ohara | D03D 13/00 442/2 |
| 2010/0248569 | A1 * | 9/2010 | Peng | H05K 1/0366 442/31 |

(Continued)

*Primary Examiner* — Bobby Muromoto, Jr.

(74) *Attorney, Agent, or Firm* — Lin & Associates Intellectual Property, Inc.

(57) ABSTRACT

A weaving method for a damper of a loudspeaker includes the steps of: a preparation step: providing a plurality of traditional warps and a plurality of conductive warps to extend in a vertical direction; and a weaving step: providing a plurality of wefts to extend in a horizontal direction transversely crossing the vertical direction in such a manner that each of the wefts passes alternately over and under each of the plurality of traditional warps and each of the plurality of conductive warps in order to form the damper.

10 Claims, 7 Drawing Sheets

(56) References Cited

U.S. PATENT DOCUMENTS

| | | | | |
|---|---|---|---|---|
| 2011/0140539 | A1* | 6/2011 | Yamamoto | H01B 7/30<br>307/104 |
| 2011/0188699 | A1* | 8/2011 | Shibaoka | D03D 1/0088<br>381/428 |
| 2014/0047807 | A1* | 2/2014 | Elsasser | B01D 39/20<br>55/486 |

* cited by examiner

WEAVING METHOD FOR A DAMPER OF A LOUDSPEAKER

BACKGROUND OF THE INVENTION

1. Field of the Invention

The present invention relates generally to a damper of a loudspeaker; and more particularly to a weaving method for a damper of a loudspeaker such that the damper is suitable for fixing a voice coil of the loudspeaker.

2. The Prior Arts

A loudspeaker generally includes a sound vibration system consisting of a voice coil, a diaphragm (cone) and a damper (spider). A traditional damper includes a main body and several conductive wires wound around the main body and further connected to the voice coil and the diaphragm. One prime function of the damper is to center the diaphragm at correct position relative to the voice coil and the other function is to force forward and back movements of the voice coil to be linear, so that the voice coil does not scrape the narrow magnetic gap and lastly to define proper resonance efficiency together with the voice coil. The damper also prevents dust from getting into interior of the narrow magnetic gap.

A traditional weaving method includes weaving a damper fabric in advance. The damper fabric is later divided manually into two groups, each consisting of a plurality of fiber strands which are stitched on a semi-finished frame so as to form the damper. It is time-consuming and results in labor waste.

Moreover, the traditional weaving method may cause damage to the structure of the damper, which, in turn, affects the resonance efficiency which is defined by the voice coil in combination with the diaphragm. In other words, the service life of the damper is shortened, hence the loudspeaker is.

In addition, in the above-mentioned weaving method, the plurality of fiber strands of each group are located densely, therefore the heat-dissipating effect is poor and hence is easily overheated.

Another traditional weaving method includes the steps of weaving two fabric pieces in advance, after which, a plurality of conductive wires are grouped into two sets. The conductive wires of each set are interlaced into a respective fabric piece so as to form the damper. This type of weaving method does not damage the damper structure but it consists of complicated steps, is time consuming and labor intensive and it may easily cause mis-alignment of the conductive wires. These disadvantages may lead to poor resonance efficiency among the damper, the voice coil and the diaphragm of the loudspeaker. In addition, in each group, since the plurality of conductive wires are located densely relative to one another, it is difficult to dissipate the heat effectively and hence the conductive wires may be easily overheated.

Furthermore, the location of each conductive wire in the respective group is not consistent, which, in turn, will cause inconsistency of the resonance efficiency among the voice coil and the diaphragm of the loudspeaker. In other words, each loudspeaker may have slight different sound quality because of the above problems. As far as the loudspeaker manufacturers' concern, they may encounter the problems and are unable to produce consistent quality loudspeakers

SUMMARY OF THE INVENTION

A primary objective of the present invention is to provide a weaving method for a damper of a loudspeaker such that the weaving steps are simple, do not destroy any structure and are capable of accurately fixing the conductive wires in a predetermined position, thereby reducing the weaving time, labor waste, and maintaining structure integrity of the damper. Hence, the quality of each piece of the damper is consistent and the damper has a longer service life.

Another objective of the present invention is to provide a damper for a loudspeaker such that the conductive wires of the damper are accurately positioned in a predetermined position.

The weaving method for a damper of a loudspeaker of the present invention includes the following steps.

A preparation step: where a plurality of traditional warps and a plurality of conductive warps are provided to extend in a vertical direction.

A weaving step: where a plurality of wefts are provided so as to extend in a horizontal direction transversely crossing the vertical direction in such a manner that each of the wefts passes alternately over and under each of the plurality of traditional warps and each of the plurality of conductive warps in order to form the damper.

Preferably, in the preparation step, the plurality of conductive warps are grouped into a first set including a plurality of first conductive warps and a second set including a plurality of second conductive warps, wherein each of the traditional warps is disposed between an adjacent pair constituting by one first conductive warp and one second conductive warp proximate to the first conductive warp.

In one embodiment, in the preparation step, each of the traditional warps is disposed between an adjacent pair of the conductive warps. More preferably, the plurality of conductive warps are grouped into a first set including a plurality of first conductive warps and a second set including a plurality of second conductive warps of conductive warps. Under this condition, each of the traditional warps is disposed between an adjacent pair constituting by one first conductive warp and one second conductive warp proximate to the first conductive warp.

Preferably, the plurality of traditional warps and the plurality of the conductive warps are made from metals.

A damper for a loudspeaker of the present invention includes: a plurality of traditional warps and a plurality of conductive warps extending in a vertical direction; and a plurality of wefts extending in a horizontal direction transversely crossing the vertical direction in such a manner that each of the wefts passes alternately over and under each of the plurality of traditional warps and each of the plurality of conductive warps in order to form the damper.

In one embodiment, the plurality of conductive warps are grouped into a first set including a plurality of first conductive warps and a second set including a plurality of second conductive warps of conductive warps. Under this condition, each of the traditional warps is disposed between the plurality of first conductive warps and the plurality of second conductive warps. Alternately, the plurality of first conductive warps are disposed between an adjacent pair of the traditional warps and the plurality of the second conductive warps are disposed between another adjacent pair of the traditional warps.

In one embodiment, each of the traditional warps is disposed between an adjacent pair of the conductive warps. More preferably, the plurality of conductive warps are grouped into a first set including a plurality of first conductive warps and a second set including a plurality of second conductive warps of conductive warps. Under this condition, each of the traditional warps is disposed between an adjacent pair constituting by one first conductive warp and one second conductive warp proximate to the first conductive warp.

Preferably, the plurality of warps and the plurality of the wefts are made from metals.

One specific feature of the present invention resides in that the weaving method includes only two steps to precisely interlace the conductive wires at predetermined position in simple way without destroying the structure and any deviation, thereby reducing the weaving time, labor waste in addition to providing structural integrity and effectiveness of the optimal fixing of each fabric piece in consistency relative to each other. Further each damper weaved accordingly has a longer service life and consistent quality of resonance efficiency in each loudspeaker is maintained. In addition, the warps and wefts will not retract in the horizontal direction such that the warps and wefts are not excessively bent.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
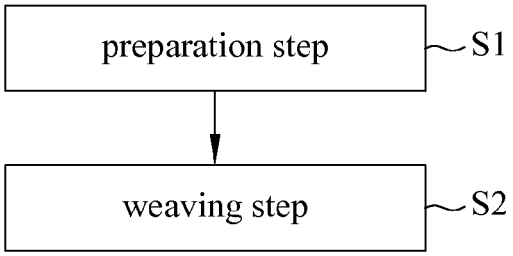
FIG. 1 is a block diagram illustrating the steps constituting a weaving method for a damper of a loudspeaker according to the present invention.
Figure 2:
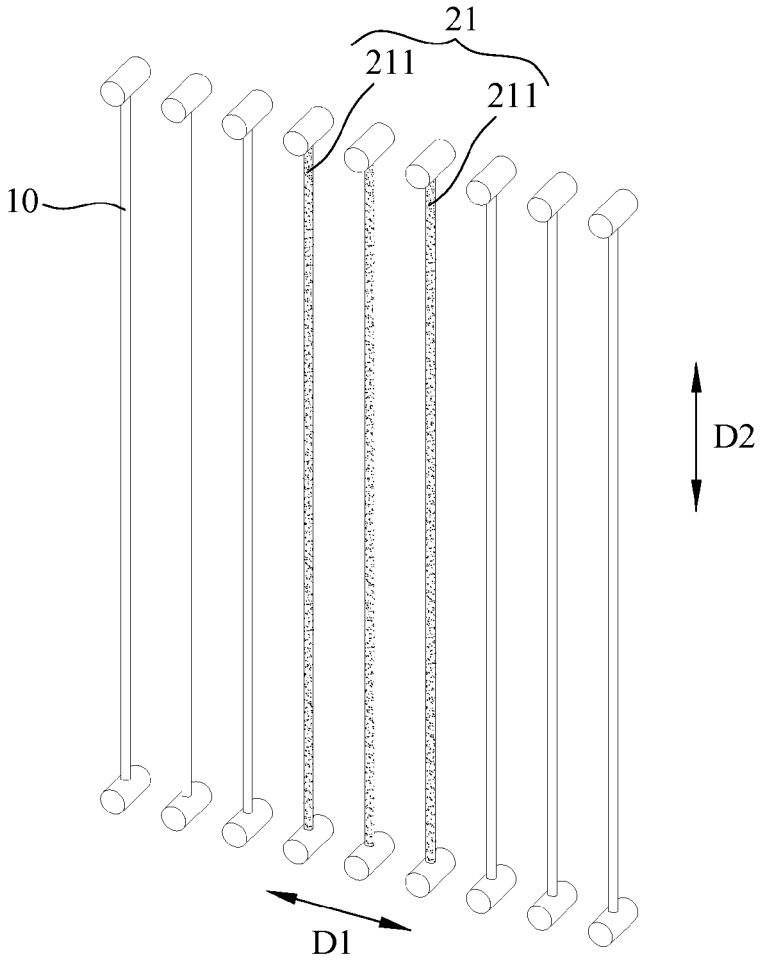
FIG. 2 shows a perspective view of the first embodiment of a preparation step constituting a weaving method for a damper of a loudspeaker according to the present invention.
Figure 3:
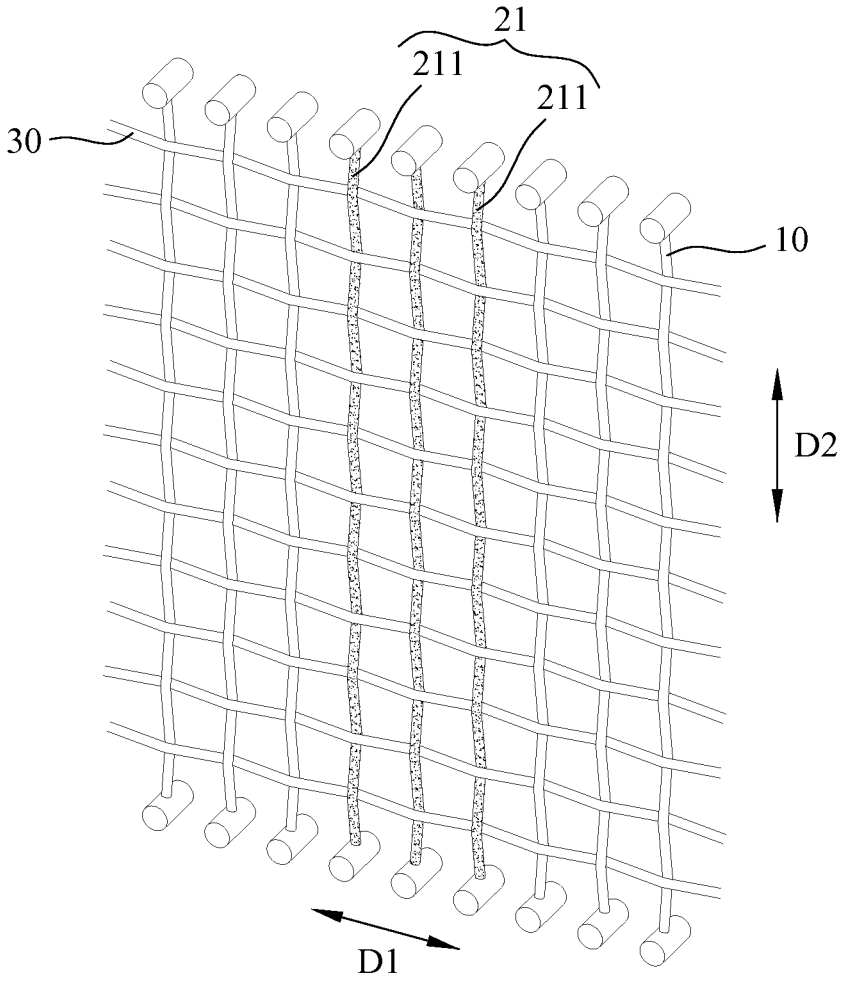
FIG. 3 shows a perspective view of the first embodiment of the weaving step in the weaving method for the damper of the loudspeaker according to the present invention.
Figure 4:
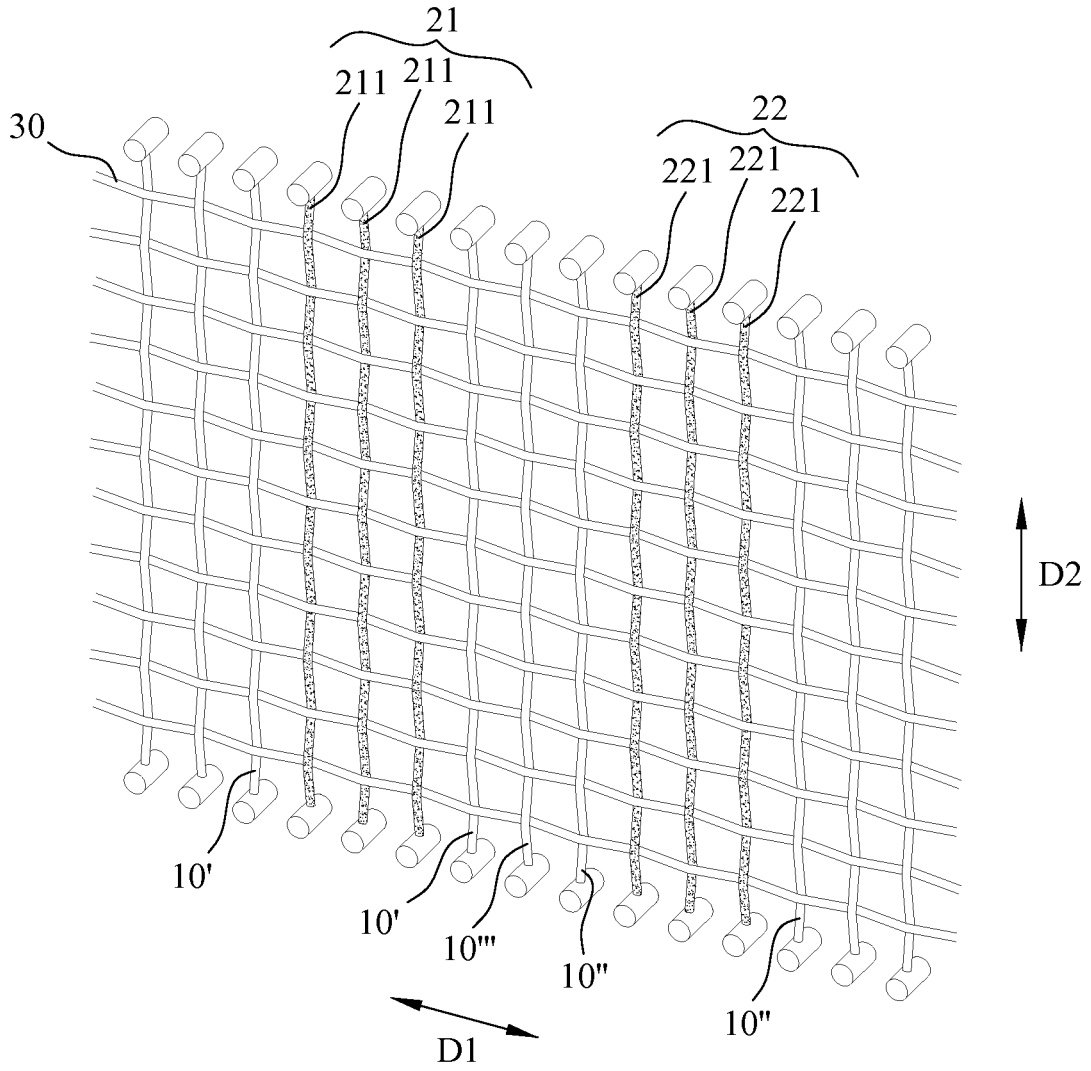
FIG. 4 shows a finished view of the first embodiment in the weaving method for the damper of the loudspeaker according to the present invention.

Referring to FIGS. 1-4, wherein FIG. 1 is a block diagram illustrating the steps constituting a weaving method for a damper of a loudspeaker according to the present invention; FIG. 2 shows a perspective view of the first embodiment of a preparation step constituting a weaving method for a damper of a loudspeaker according to the present invention; FIG. 3 shows a perspective view of the first embodiment of the weaving step in the weaving method for the damper of the loudspeaker according to the present invention; and FIG. 4 shows a finished view of the first embodiment in the weaving method for the damper of the loudspeaker according to the present invention. The weaving method according to the present invention includes the following steps.

A preparation step S1: where a plurality of parallely spaced traditional warps 10 and a plurality of parallely spaced conductive warps 211, 221 are provided in such a manner to extend in a vertical direction D2. To be more specific, two opposite ends of each traditional warp 10 and two opposite ends of each conductive warps 211, 221 are fixed to a loom frame (not visible) via holding elements, as best shown in FIG. 2. The traditional warps 10 are made from metals, but should not be limited only thereto. In this embodiment, the plurality of conductive warps are grouped into a first set 21 including a plurality of first conductive warps 211 and a second set 22 including a plurality of second conductive warps 221. Note that the first and second conductive warps 211, 221 also extend in the vertical direction. Preferably, at least one traditional warp 10 is disposed between the first and second sets 21, 22. To be more specific, at least one traditional warp 10 is disposed between a plurality of parallely spaced first conductive warps 211 and a plurality of parallely spaced second conductive warps 221. As best shown in FIG. 4, three traditional warps 10', 10", 10''' are disposed between the first set 21 constituted by a plurality of first conductive warps 211 and the second set 22 constituted by a plurality of second conductive warps 221. In this embodiment, the plurality of first conductive warps 211 are disposed between an adjacent pair of the traditional warps 10' and the plurality of second conductive warps 22 are disposed between another adjacent pair of the traditional warps 10". In other words, not a single traditional warp 10' is disposed among the first conductive warps 211 and not a single traditional warp 10" is disposed among the second conductive warps 221. Referring again to FIG. 4 again, the first set 21 may include 3, 5 or 8 first conductive warps 211 and the second set 22 may include 3, 5 or 8 second conductive warps 221.

A weaving step S2: where a plurality of wefts 30 are provided to extend in a horizontal direction D1 transversely crossing the vertical direction D2 in such a manner that each of the wefts 30 passes alternately over and under each of the plurality of traditional warps 10 and each of the plurality of conductive warps 211, 221 in order to form the damper. As shown in FIGS. 3 and 4, the wefts 30 are made from metals, but should not be limited only thereto.

Figure 5:
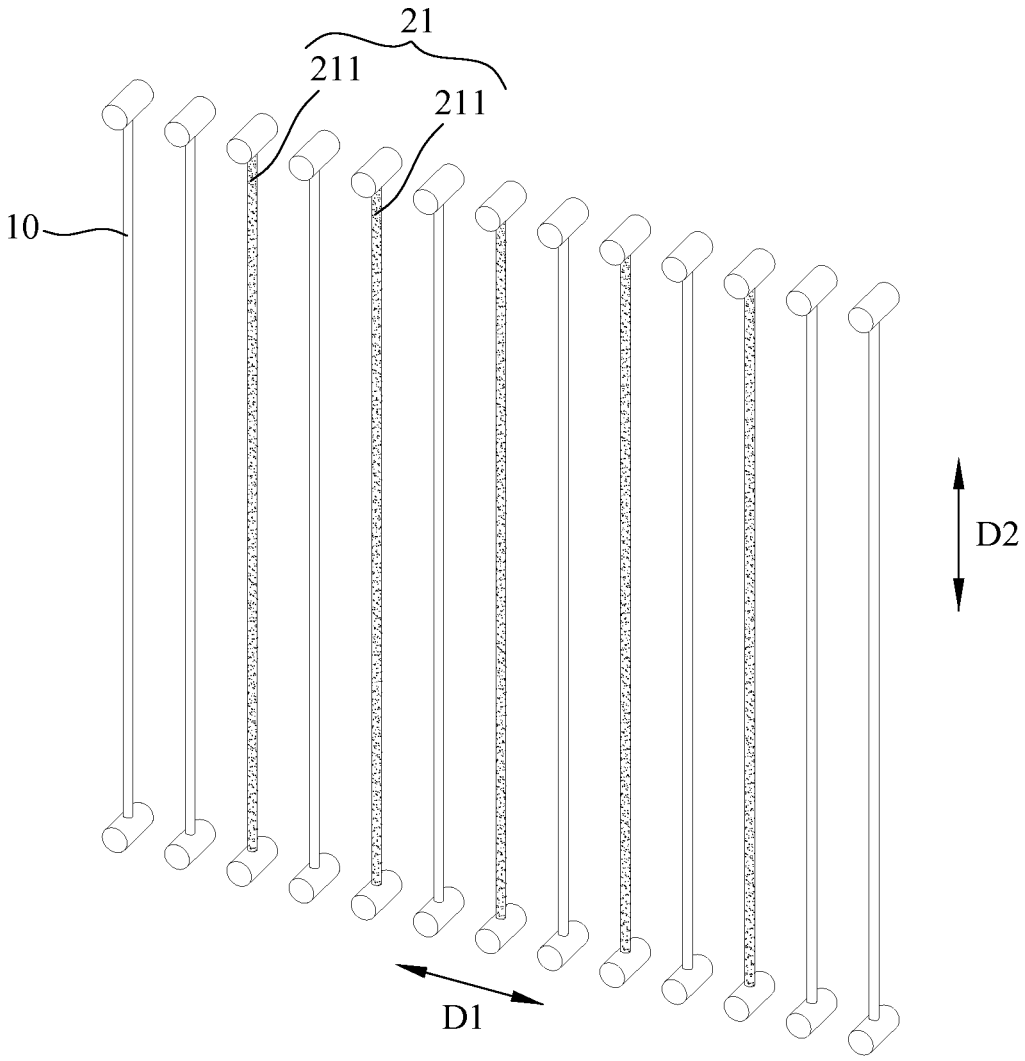
FIG. 5 shows a perspective view of the second embodiment of the preparation step constituting the weaving method for a damper of a loudspeaker according to the present invention.
Figure 6:
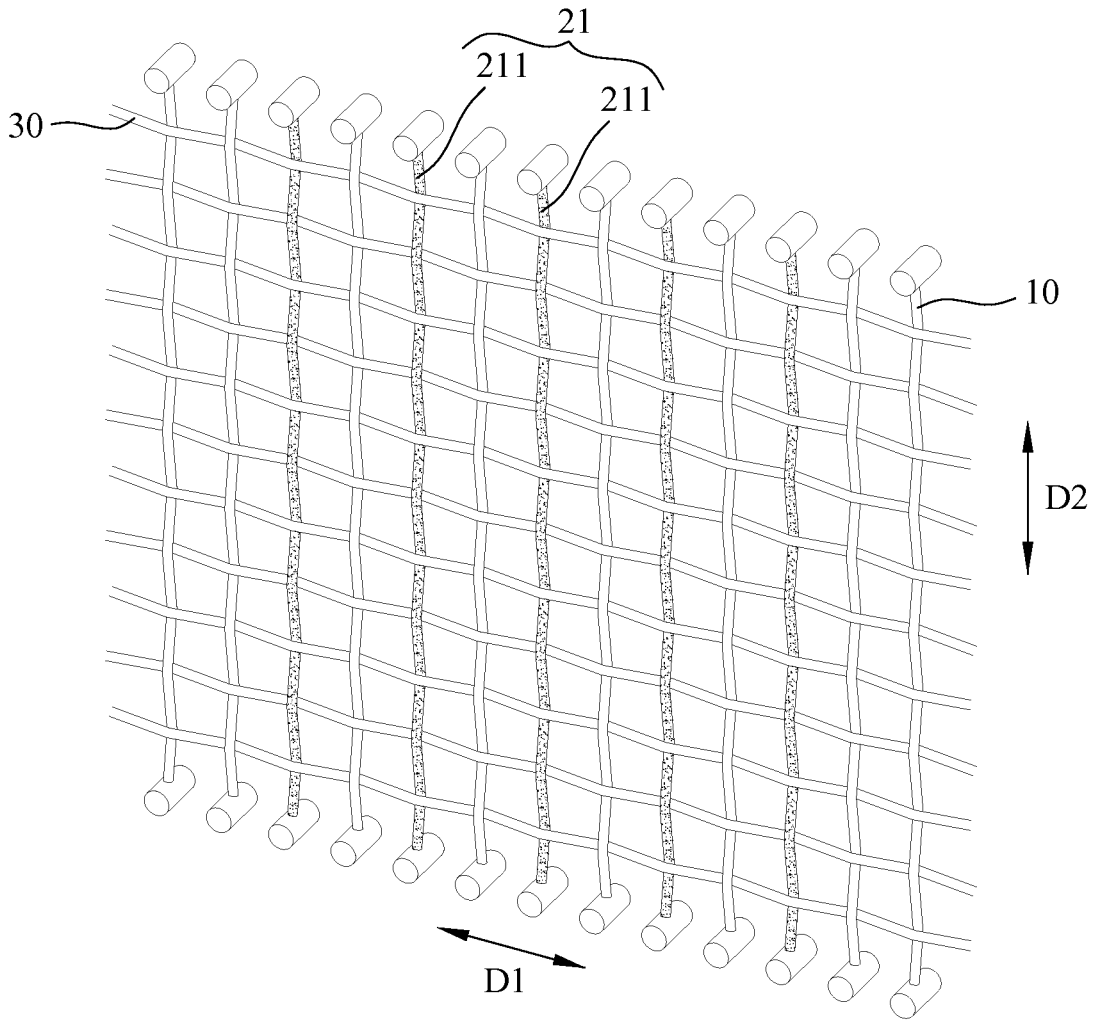
FIG. 6 shows a perspective view of the second embodiment of the weaving step in the weaving method for the damper of the loudspeaker according to the present invention.
Figure 7:
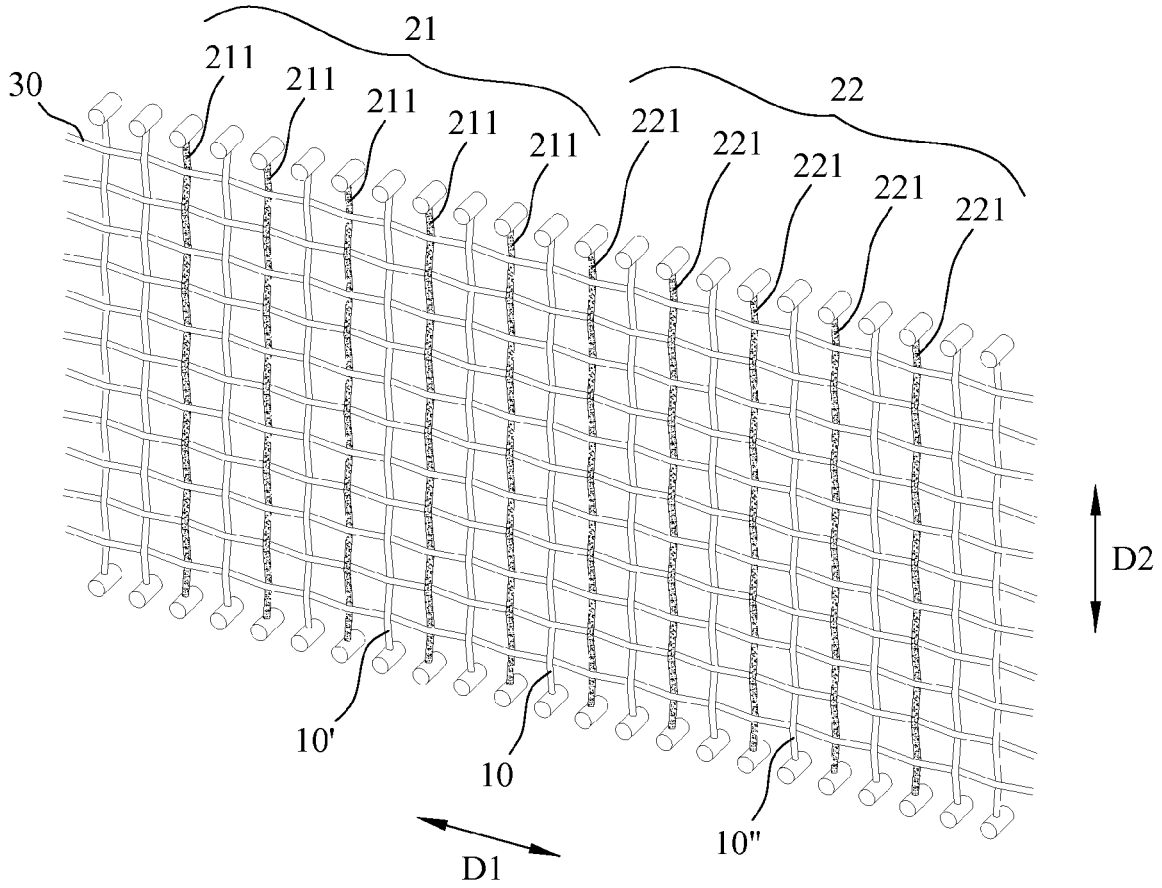
FIG. 7 shows a finished view of the second embodiment in the weaving method for the damper of the loudspeaker according to the present invention.

Referring to FIGS. 5-7, wherein FIG. 5 shows a perspective view of the second embodiment of the preparation step constituting the weaving method for a damper of a loudspeaker according to the present invention; FIG. 6 shows a perspective view of the second embodiment of the weaving step in the weaving method for the damper of the loudspeaker according to the present invention; and FIG. 7 shows a finished view of the second embodiment in the weaving method for the damper of the loudspeaker according to the present invention. The second embodiment is generally similar to the first embodiment, except in that in the second embodiment, each of the traditional warps 10' is disposed between an adjacent pair of the first conductive warps 211 and each of the traditional warps 10" is disposed between an adjacent pair of the second conductive warps 221 (see FIG. 7).

Figure 8:
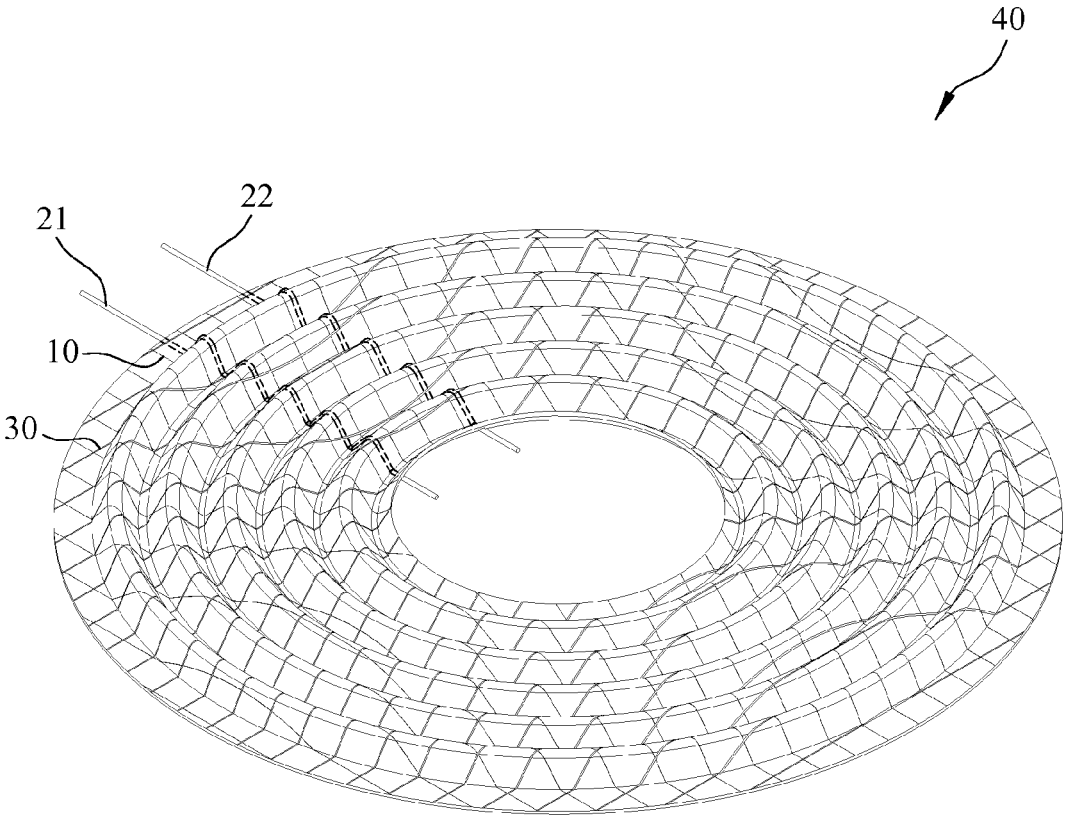
FIG. 8 shows a perspective view of a damper for a loudspeaker produced by the weaving method of the present invention.

The damper 40 of the loudspeaker obtained via the above-mentioned preparation step S1 and the weaving step S2 still need to undergo an immersion process, a drying process, a formation process and a cutting-off process such that the finished damper 40 is disc-shaped profile and has a circular inner periphery defining a central hole with an axis, a circular outer periphery and a plurality of concentrically located annular corrugated portions extending outwardly and radially from the inner periphery such that each of the corrugated portions has an apex and a valley defined between an adjacent pair of the corrugated portions, as best shown in FIG. 8.

Referring to FIGS. 4, 7 and 8, a damper 40 of the loudspeaker of the present invention is woven according the above-mention method includes a plurality of traditional warps 10 and a plurality of conductive warps 211, 221 and a plurality of wefts 30. The plurality of traditional warps 10 and the plurality of conductive warps 211, 221 extend in a vertical direction D2 while the plurality of wefts 30 extend in a horizontal direction D1 transversely crossing the vertical direction D2 in such a manner that each of the wefts 30 passes alternately over and under each of the plurality of traditional warps 10 and each of the plurality of conductive warps 211, 221 in order to form the damper 40. The traditional warps 10 and the wefts are made from metals, but should not be limited only thereto. In this embodiment, the plurality of conductive warps 211, 221 are grouped into a first set 21 including a plurality of first conductive warps 211 and a second set 22 including a plurality of second conductive warps 221. Note that the first and second conductive warps 211, 221 also extend in the vertical direction D2. Preferably, at least one traditional warp 10 is disposed between the first and second sets 21, 22. To be more specific, at least one traditional warp 10 is disposed between the plurality of parallely spaced first conductive warps 211 and the plurality of parallely spaced second conductive warps 221. As best shown in FIG. 4, three traditional warps 10', 10", 10'" are disposed between the first set 21 constituted by a plurality of first conductive warps 211 and the second set 22 constituted by a plurality of second conductive warps 221. In this embodiment, the plurality of first conductive warps 211 are disposed between an adjacent pair of the traditional warps 10' and the plurality of second conductive warps 221 are disposed between another adjacent pair of the traditional warps 10". In other words, not a single traditional warp 10' is disposed among the first conductive warps 211 and not a single traditional warp 10" is disposed among the second conductive warps 221. FIG. 7 shows a finished view of the second embodiment of the damper 40 produced according to the weaving method according to the present invention and has the structure similar to the previous embodiment, except in that one traditional warp 10 is disposed between an adjacent pair constituting by one first conductive warp 211 and one second conductive warp 221 proximate to the one of the first conductive warp 211, while one traditional warp 10' is disposed between an adjacent pair of the first conductive warps 211 and another traditional warp 10" is disposed between an adjacent pair of the second conductive warps 221. Preferably, the first set 21 may include 3, 5 or 8 first conductive warps 211 and the second set 22 may include 3, 5 or 8 second conductive warps 221.

It is to note that the damper 40 produced according to the weaving method of the present invention is implemented in a loudspeaker (not visible) that also includes a voice coil and a diaphragm such that during the installation, the inner ends of the first and second sets 21, 22 extend inwardly from the inner periphery of the damper 40 to connect with the voice coil while the outer ends of the first and second sets 21, 22 extend outwardly from the outer periphery of the damper 40 to connect with the diaphragm.

It is to note that the weaving method of the present invention for producing the damper 40 includes only two steps, namely providing the conductive warps 211, 221 among the traditional warps 10 such that all extend in the vertical direction; and then providing the plurality of the wefts 30 in such a manner they extend in the horizontal direction transversely crossing the vertical direction and each of the wefts passes alternately over and under each of the plurality of traditional warps 10 and each of the plurality of conductive warps 211, 221. These two steps are capable of accurately fixing the conductive warps 211, 221 in a predetermined position relative to the voice coil and the diaphragm, thereby reducing the weaving time, labor waste, and maintaining structure integrity of the damper. Hence, the damper 40 has a longer service life.

Furthermore, since the fixing position of the conductive warps 211, 221 in the damper of the present invention is consistent, the quality of resonance efficiency of each piece of the damper is maintained at a predetermined standard.

One feature to note is that during the weaving process, since two opposite ends of the warps 10 are fixed firstly to the loom frame (not visible) to extend in the vertical direction D2 and after which the wefts 30 pass alternately over and under each of the warps 10. Thus, in a freshly woven damper, the warps 10 do not retract in the vertical direction when compared to the horizontal extending wefts 30 so that no extra bending of the conductive warps 211, 221 is caused in the vertical direction D2.

In one embodiment of the weaving method of the present invention, the plurality of first conductive warps 211 are disposed between an adjacent pair of the traditional warps 10', the plurality of second conductive warps 221 are disposed between another adjacent pair of the traditional warps 10" while at least one or more traditional warps 10, 10', 10" are disposed between the first and second sets 21, 22. Under this condition, the assembler can differentiate the first and second sets 21, 22 relative to each other during installing the damper of the present invention relative to the voice coil and the diaphragm of the loudspeaker, thereby reducing the undesired in proper installation.

In another embodiment of the weaving method of the present invention, a single traditional warp 10 is disposed between an adjacent pair of the first conductive warps 211 and another single traditional warp 10 is disposed between an adjacent pair of the second conductive warps 221. In a freshly woven damper, since the first and second warps 211 and 221 are not located densely relative to one another, the heat generated in combination of the first and second conductive warps 211, 221 is dissipated by adjacent traditional warps 10. In other words, the damper of the present invention possesses high heat dissipation effect. In the event all the traditional warps 10 are made from metals, the heat dissipation effect of the first and second conductive warps 211, 221 is increased tremendously. Moreover, since distribution of the first and second conductive warps 211, 221 among the traditional warps 10 is even and uniform, accurately fixing the opposite ends of the first and second conductive warps 211, 221 of the damper 40 relative to the voice coil and the diaphragm can be carried out by an assembler during assembly of a loudspeaker.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A weaving method for manufacturing a damper of a loudspeaker, comprising the steps of:

a preparation step: providing a plurality of traditional warps and a plurality of conductive warps to extend in a vertical direction; and a weaving step: providing a plurality of wefts to extend in a horizontal direction transversely crossing the vertical direction in such a manner that each of the wefts passes alternately over and under each of the plurality of traditional warps and each of the plurality of conductive warps in order to form the damper;

wherein after the weaving step, the damper undergoes an immersion step, a drying step, a formation step and a cutting-off step to shape the damper in a disc-shaped profile with a circular inner periphery defining a central hole, a circular outer periphery and a plurality of annular concentric corrugated portions extending outwardly and radially from the inner periphery, each of the corrugated portions having an apex and a valley defined between an adjacent pair of the corrugated portions, inner ends of the conductive warps extending inwardly from the circular inner periphery for connecting with a voice coil and outer ends of the conductive warps extending outwardly from the outer periphery for connecting with a diaphragm.

2. The weaving method according to claim 1, wherein in the preparation step, the plurality of conductive warps are grouped into a first set including a plurality of first conductive warps and a second set including a plurality of second conductive warps, wherein each of the traditional warps is disposed between an adjacent pair constituting by one of the first conductive warps and one of the second conductive warps proximate to the one of the first conductive warps.

3. The weaving method according to claim 1, wherein in the preparation step, each of the traditional warps is disposed between an adjacent pair of the conductive warps.

4. The weaving method according to claim 3, wherein in the preparation step, the plurality of conductive warps are grouped into a first set including a plurality of first conductive warps and a second set including a plurality of second conductive warps, at least one traditional warp is disposed between the first set and the second set, and at least one traditional warp is disposed between an adjacent pair of the first conductive warps, and at least one traditional warp is disposed between an adjacent pair of the second conductive warps.

5. The weaving method according to claim 1, wherein the plurality of traditional warps and the plurality of wefts are made from metals.

6. A damper of a loudspeaker comprising:

a plurality of traditional warps and a plurality of conductive warps extending in a vertical direction; and a plurality of wefts extending in a horizontal direction transversely crossing the vertical direction in such a manner that each of the wefts passes alternately over and under to interlace with each of the plurality of traditional warps and each of the plurality of conductive warps in order to form the damper;

wherein the damper has a disk-shaped profile with a circular inner periphery defining a central hole, a circular outer periphery and a plurality of annular concentric corrugated portions extending outwardly and radially from the inner periphery, each of the corrugated portions having an apex and a valley defined between an adjacent pair of the corrugated portions, inner ends of the conductive warps extending inwardly from the circular inner periphery for connecting with a voice coil and outer ends of the conductive warps extending outwardly from the outer periphery for connecting with a diaphragm.

7. The damper according to claim 6, wherein the plurality of conductive warps are grouped into a first set including a plurality of first conductive warps and a second set including a plurality of second conductive warps, wherein each of the traditional warps is disposed between an adjacent pair constituting by one of the first conductive warps and one of the second conductive warps proximate to the one of the first conductive warps.

8. The damper according to claim 6, wherein each of the traditional warps is disposed between an adjacent pair of the conductive warps.

9. The damper according to claim 8, wherein the plurality of conductive warps are grouped into a first set including a plurality of first conductive warps and a second set including a plurality of second conductive warps, at least one traditional warp is disposed between the first set and the second set, and at least one traditional warp is disposed between an adjacent pair of the first conductive warps and at least one traditional warp is disposed between an adjacent pair of the second conductive warps.

10. The damper of claim 6, wherein the plurality of traditional warps and the plurality of wefts are made from metals.

* * * * *